US005145070A

United States Patent [19]

Pallett et al.

[11] Patent Number: 5,145,070

[45] Date of Patent: Sep. 8, 1992

[54] ONE-PIECE CORRUGATED BOX WITH INTERIOR SUPPORTS

[75] Inventors: William L. Pallett, Plainwell; Scott Speese, Kalamazoo; Lloyd R. Dixon, Bellevue, all of Mich.

[73] Assignee: Arvco Container Corporation, Kalamazoo, Mich.

[21] Appl. No.: 754,759

[22] Filed: Sep. 4, 1991

[51] Int. Cl.[5] ..... B65D 81/02

[52] U.S. Cl. ..... 206/521; 206/592; 206/491

[58] Field of Search ..... 206/521, 586, 587, 590, 206/592, 491

[56] References Cited

U.S. PATENT DOCUMENTS 3,211,282 10/1965 Hennessey ..... 206/587 X
3,239,127 3/1966 Spencer ..... 206/521

OTHER PUBLICATIONS

Photos labeled A, B, C & D of Prior Art Box sold one year prior to Sep. 4, 1991.

*Primary Examiner*—William I. Price
*Attorney, Agent, or Firm*—Flynn, Thiel, Boutell & Tanis

[57] ABSTRACT

A one-piece, top opening, container which is preferably made of multiply corrugated cardboard. The container comprises a pair of opposed end wall panels and a pair of opposed side wall panels foldably joined together to form a tubular structure, and top and bottom closures for closing opposite ends of the container. The bottom closure comprises at least one object support or platform which projects upwardly into the container and is adapted for supporting the object that is to be packaged therein. The object support includes foldably joined panel sections and it has an edge which is joined by a fold line to one of the wall panels of the container so that the panel sections of the support can lie substantially flat against the lower portion of the one end wall panel when the container is in a knockdown condition. The top closure comprises at least one restraint wall which extends across the interior of the container at a location spaced downwardly from the upper end thereof. The restraint wall engages the object packaged in the container to restrain movement of the object. The restraint wall is integral with one of the wall panels of the container and is foldably joined thereto by a fold line.

16 Claims, 3 Drawing Sheets

ONE-PIECE CORRUGATED BOX WITH INTERIOR SUPPORTS

FIELD OF THE INVENTION

This invention relates to a package structure and, in particular, an improved corrugated cardboard box provided with integral interior supports for engaging and restraining movement of an object or objects that are packaged in the box.

BACKGROUND OF THE INVENTION

It is common to pack objects, particularly irregularly shaped objects, in corrugated board containers (i.e. boxes) and to provide in such containers various kinds of cushioning materials and restraints in order to restrain movement of the objects in the container and protect them from damage. It is also known to place separate corrugated board inserts in corrugated board containers for the same purposes. However, these prior art packaging techniques are not fully satisfactory because several different manufacturing steps are required to provide the different parts that make up the total package. The shipment, storage and inventory of the different parts is relatively difficult and the assembly operation is more complex and expensive than is desired.

Accordingly, it is an object of the present invention to provide an improved one-piece corrugated box provided with integral interior supports for restraining movement of objects packaged in the containers and protect them from damage.

It is a further object of this invention to provide an improved one-piece corrugated box with interior supports which is more economical to assemble at the point of use because it consists of a single piece.

It is a still further object of the invention to provide a one-piece corrugated box with interior supports which is more easy to manufacture, store and ship because only a single blank needs to be handled.

It is also an object of the invention to provide an improved one-piece corrugated box with interior supports, as aforesaid, which can be pre-glued at the manufacturing stage in order to form a stronger box but which permits the blanks to be shipped in a knock-down flat condition for convenience in shipping and handling.

SUMMARY OF THE INVENTION

According to the invention, there is provided a one-piece, top opening, container which is preferably made of multiply corrugated cardboard. The container which is comprised of a pair of opposed end wall panels and a pair of opposed side wall panels which are foldably joined together to form a tubular structure and which are provided with top and bottom closure means for closing the opposite ends of the container. The bottom closure means comprises at least one object support or platform which projects upwardly into the container and is adapted for supporting the object that is to be packaged in the container. The object support includes foldably joined panel sections and it has an edge which is joined by a fold line to one of the wall panels of the container so that the panel sections of the support can lie substantially flat against the lower portion of the one end wall panel when the container is in a knockdown condition. The top closure means comprises at least one restraint wall which extends across the interior of the container at a location spaced downwardly from the upper end of the container. The restraint wall has means for engaging the object that is packaged in the container in order to restrain movement of the object. The restraint wall is integral with one of the wall panels of the container and is foldably joined thereto by a fold line.

Other objects and purposes of the invention will be apparent to persons familiar with structures of this type upon reading the following specification and inspecting the accompanying drawings.

DETAILED DESCRIPTION

Figure 1:
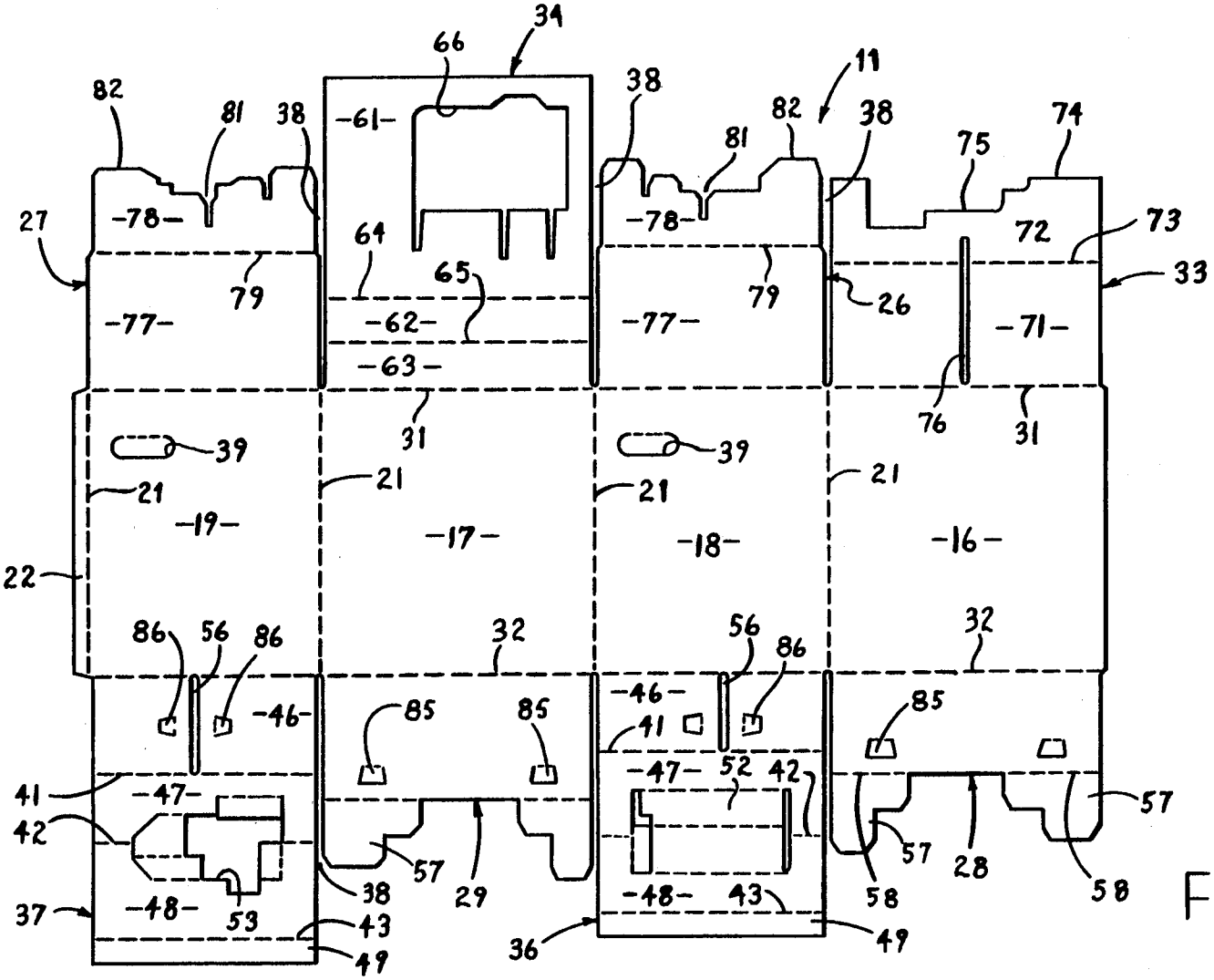
FIG. 1 is a plan view of the blank used for preparing the container according to the present invention.
Figure 2:
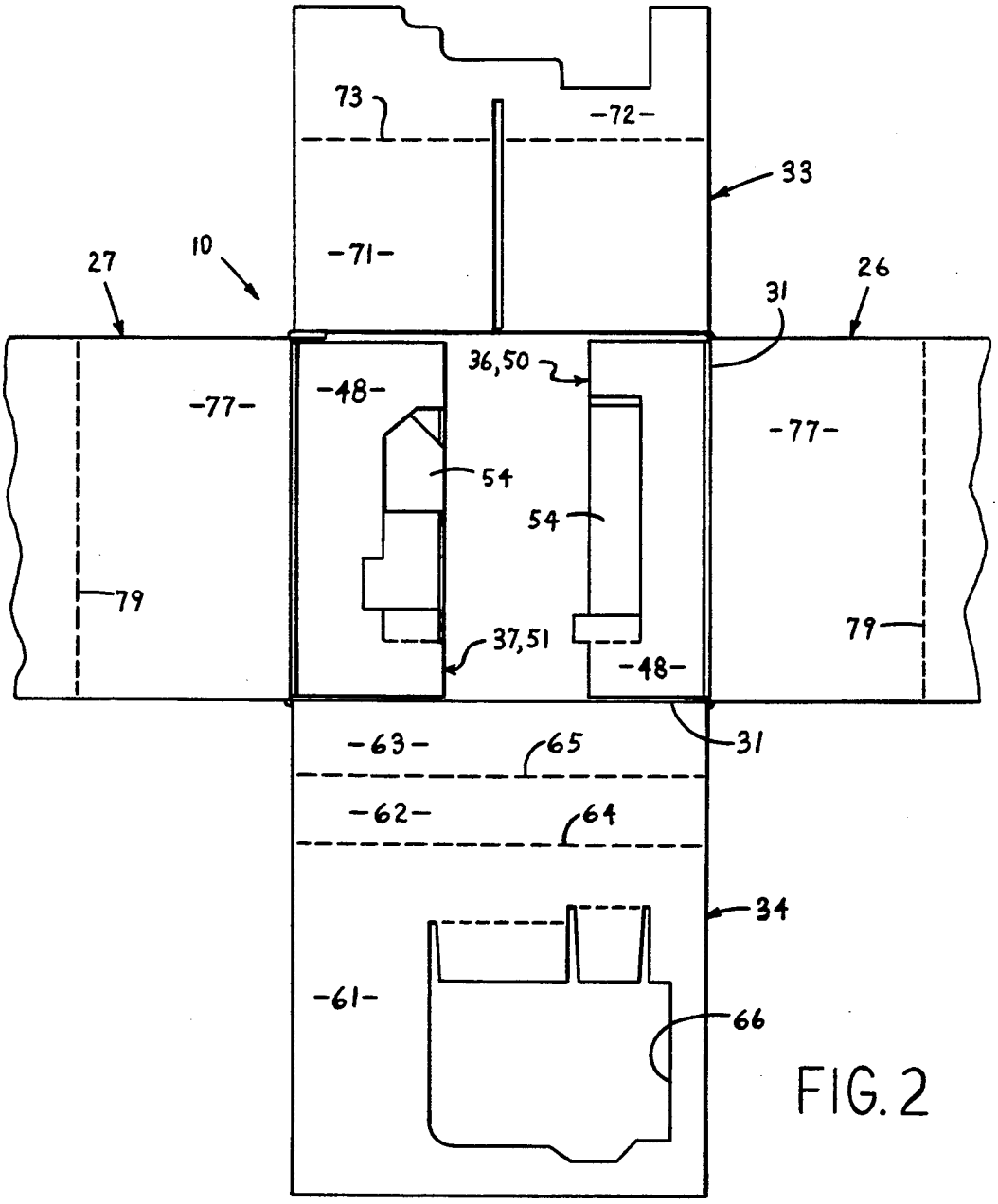
FIG. 2 is a top view of the assembled container with the upper closure means of the container opened so that the interior of the container can be seen.

Referring to the drawings, there is illustrated a closeable six-sided container or box 10 according to the present invention, which box is formed from a flat one-piece blank 11. The blank 11 for forming the box is constructed from conventional corrugated cardboard.

The blank 11 used for forming the container 10 has opposed rectangular side walls 16 and 17 which are joined between opposed rectangular end walls 18 and 19. The walls 16–19 are joined integrally in series and are separated by transversely extending fold or score lines 21. The end wall 19, at the free edge thereof, has an outwardly projecting glue strip 22 which is also separated from the end wall by a fold line 21. This glue strip is adapted to overlap and be adhesively secured to the inner surface of the side wall 16 to hence form a tubular side wall structure for the box, which tubular side wall structure can be flattened for shipping and storage.

The container also includes outer top flaps 26 and 27, respectively, which project outwardly from the upper edges of the end walls 18 and 19. Similar outer bottom flaps 28, 29, respectively, project from the opposite edges of the side walls 16 and 17. The top flaps 26 and 27 define an opposed pair for closing off the upper end of the container. Similarly, the bottom flaps 28 and 29 define an opposed pair for closing off the bottom of the container, as explained in greater detail hereinafter.

The top flaps 26 and 27 are integrally joined to their respective end walls through a fold line 31 which extends longitudinally throughout the entire length of the blank 11. A similar fold line 32 extends longitudinally of the blank so as to define the transition between the bottom flaps 28 and 29 and their connection to the respective side walls 16 and 17.

Container 10 also includes additional inner flaps which are disposed under the outer flaps when the container is fully assembled. More specifically, the inner flaps include an inner top flap 33 which projects upwardly from the upper edge of the side wall 16, an inner top flap 34 which projects upwardly from the upper edge of side wall 17, an inner bottom flap 36 which projects downwardly from the lower edge of end wall 18 and an inner bottom flap 37 which projects downwardly from the lower edge of end wall 19. That is, flaps 33 and 34 project upwardly from fold line 31, whereas flaps 36 and 37 project downwardly from fold line 32.

The longitudinally adjacent pairs of flaps are separated by intermediate slots or slits 38 which are aligned with the transverse fold lines 21 and project inwardly from the longitudinal free edges of the blank so as to terminate at the longitudinal fold lines 31 and 32.

The end walls 18 and 19 have hand holds 39 provided therein so that a user can lift the box more conveniently.

In forming the box using the blank 11 of the present invention, the box is formed in a substantially conventional manner. That is, the box is folded about the fold lines 21 so as to form a generally rectangular tube. The flap 22 is disposed under the side wall 16 and is secured thereto, such as by an adhesive or by staples. The inner pairs of flaps, such as the opposed pair of top flaps 33 and 34, and the opposed pair of bottom flaps 36 and 37 are then folded inwardly about the fold lines 31 and 32. Thereafter, the opposed pair of outer flaps are folded inwardly so as to overlie the inner flaps. That is, the opposed pair of top flaps 26 and 27, and the opposed pair of bottom flaps 28 and 29, are folded inwardly to respectively overlie the inner flaps and thus close the box.

The manner in which the flaps are formed and cooperate, as briefly described above, will now be described in greater detail.

The inner bottom flaps 36 and 37 each have three, parallel, longitudinally extending fold lines 41, 42 and 43 which parallel the fold line 32 and divide the flaps into hingèdly connected sections 46, 47, 48 and 49. When the box is erected, the flap sections 46 are lowermost and extend horizontally across the upper surfaces of the outer bottom flaps 28 and 29 toward the center of the box. The flap sections 47 extend upwardly from the inner edges of sections 46. The sections 48 extend horizontally to their respectively associated end walls 18 and 19 of the box. The flap sections 49 extend upwardly along their respectively associated side walls 18 and 19 and are secured thereto, such as by gluing. The inner bottom flaps 36 and 37 thus respectively form integral, interior support platforms 50 and 51 for supporting the object that is to be packaged in the box. The adjacent sections 47 and 48 of each platform 50 and 51 can be suitably shaped, such as by forming recesses (or cut and/or fold lines) 52 and 53 therein, for receiving and interengaging with projecting portions of the object that is to be packaged so that the platforms 50 and 51 engage the object not only to support its weight, but also to hold its space from the side and bottom walls of the box and to prevent it from shifting around inside the box. The exact shapes of recesses 52 and 53 will vary depending on the shape of the object that is to be packaged in the box.

Due to the manner in which the flaps 36 and 37 are folded and glued to the respective end walls 18 and 19, these flaps and the cooperating lower portions of the end walls hence define hollow multiple flat-sided tubular structures which are located adjacent lower opposite ends of the box and extend across the width thereof. These tubular structures, which are rectangular in this embodiment, provide the box with strength and rigidity and permit safe and stationary securement of an object within the box, such as by supporting the object in raised relationship from the box bottom.

Slots 56 are provided in the sections 46 of the flaps 36 and 37, which sections directly overlie the outer bottom flaps 28, 29. The slots 56 extend perpendicularly to the fold line 32 and are adapted to receive therethrough tabs 57 which extend outwardly from the outer bottom flaps 28 and 29. Fold lines 58 are provided so that the tabs 57 can be bent so as to extend perpendicularly upwardly from the flaps 28 and 29 through the slots 56 whereby to releasably lock together the flaps 28, 29, 36 and 37 to close the bottom of the box and to provide upwardly facing platforms 50 and 51 for supporting the object that is to be packaged in the box.

Each of the outer bottom flaps 28 and 29 has a pair of locking tabs 85 formed therein in sidewardly spaced relationship. Each of these tabs 85 is formed by a three-sided cut with the remaining side being defined by a fold line which joins the tab to the bottom flap. The three-sided cut is such that the tab 85 is of a diverging tapered configuration so that the tab is of increasing width as it projects to its free end. Each of the bottom sections 46 of the inner bottom flaps 36 and 37 also has a pair of locking tabs 86 formed therein in sidewardly spaced relationship. Each tab 86 is formed by a three-sided cut similar to the tab 85, except that the tab 86 is of a converging tapered configuration so that the tab is of narrowing width as it projects to its free end. Each tab 86 is disposed so as to lie directly over one of the tabs 85 when the box is assembled, whereby manual upward bending of the tab 85 causes a corresponding upward bending of the aligned tab 86 and, due to the tapered relationship of the tabs, the tab 85 deforms and passes through the opening defining the tab 86 so as to become locked in the opening defining the tab 86, thereby locking the inner and outer bottom flaps together when the box is assembled.

After the blank is made the flaps 36 and 37 can be bent around the fold line 41 so that the sections 47, 48 and 49 extend upwardly parallel with and inside the end walls 18 and 19 so as to vertically overlap the lower portions of said end walls. In this condition of the sections 47, 48 and 49, the sections 49 can be secured to their associated end walls 18 and 19, such as by an adhesive, in order to secure the sections 47, 48 and 49 in that position. At that time, the box blank can still be folded flat for compact shipment to the place of use. When the box is erected at the point of use, the sections 46, 47 and 48 can easily be bent around the fold lines 41, 42 and 43 in order to form the support platforms 50 and 51.

Referring now to the top flaps, the inner top flap 34 is divided into a main or outer section 61 and two sides sections 62 and 63 by means of longitudinal fold lines 64 and 65 which extend parallel with the fold line 31. The main section 61 is adapted to extend horizontally across the box at a location close to, but spaced downwardly from, and substantially parallel with the top wall of the box as defined as the outer top flaps 26 and 27 when in a closed position.

A cutout or opening 66 is provided in the main section 61 for receiving the upper portion of the object therein. Thus, the main section 61 forms an endless collar or restraint effective to space the upper part of the object from the vertical walls of the box and to prevent the object from shifting around inside the box. The exact shape of the cutout 66 will vary depending upon the contour of the object that is to be packaged in the box.

When the box is erected, the two sides sections 62 and 63 will be folded down to lie along side the upper portion of the side wall 17 Thus, the main section 61 will be offset downwardly from the upper end of the box a distance equal to the sum of the vertical dimensions of the sections 62 and 63. The sections 62 and 63 are connected by a fold line 65 which permits some relative bending movement of the sections as may be needed to fit the top flap 34 in place during erection of the box and/or packaging of the object.

The inner top flap 33 has a main inner section 71 and a downwardly bendable outer section 72 which are connected by a longitudinally extending fold line 73. The main section 71 of flap 33 is adapted to be bent over so as to extend parallel with but spaced upwardly from the main section 61 of the flap 34, whereby main inner section 71 is positionable directly under flaps 26, 27 when closed. The bendable section 72 is bent so as to extend vertically downwardly so that its lower free edge 74 abuts against the upper surface of the main flap section 61 whereby to confine the flap section 61 against upward vertical movement. The free edge 74 may also be provided with a contoured recess 75 which is shaped to engage and conform to the object in the box. The main section 71 of flap 33 has a slot 76 therethrough and extending perpendicularly to the fold line 31 at a location approximately midway between the longitudinal ends of the flap 33.

The outer top flaps 26 and 27 each comprise a main inner portion 77 and a downwardly bendable outer locking portion 77 which are connected by a fold line 79. The main portions 77 of the flaps 26 and 27 are adapted to be bent over and directly overlie the main section 71 of flap 33 whereby to form the top wall of the box. The locking portions 78 of flaps 26 and 27 are bent downwardly so as to extend through the slots 74 whereby to releasably lock the top flaps 26 and 27 in place so that they form the top wall of the box. The locking portions 78 have slots 81 opening perpendicularly from the free edges thereof, which slots 81 accommodate the flap section 72 of flap 33 when the box is closed. The lower free edges 82 of the flaps 26 and 27 abut against the upper surface of main flap section 61 so as to assist in restraining flap 34 against upward vertical movement. The free edges of the flap sections 77 are also cut or recessed so as to cooperate with the contour of the object that is packaged in the box in order to assist in holding the object in place in the box. The exact configuration of the free edges of flaps 72, 77 and 77 will vary depending upon the shape of the object.

It is a feature of the invention that the top flap 34 is integral with the blank so that the top collar section 61 can be used to hold the object in place, and it is not necessary to provide a separate collar for this purpose. The other top flaps 26, 27 and 33 also contribute to the effect as they serve to restrain vertical upward movement of the top collar section.

The assembly of the blank 11 to create a flat or knock-down box, and the subsequent erection of the knock-down box to permit closure of an object therein, will now be described.

When the blank 11 has been stamped or die cut from a large sheet of corrugated cardboard so as to result in formation of the one-piece blank as illustrated by FIG. 1, then minor subsequent processing and subassembly steps are required so as to form the blank into a box in a flat or knock-down condition. Starting with the blank in the condition illustrated by FIG. 1, the inner bottom flaps 36 and 37 are both folded upwardly and inwardly about the fold line 41, resulting in the section 47 directly overlying the section 46, and the sections 48 and 49 directly overlying the lower portion of the respective end wall 18 or 19. The end section or strip 49 as provided at the free end of each of the flaps 36 and 37 is then adhesively secured, as by gluing, directly to the inner surface of the respective end wall 18 or 19. Thereafter the entire blank is folded in half. For example, end wall 19 is folded upwardly and then rightwardly in FIG. 1 about its fold line 21 so that wall 19 directly overlies the wall 17, and then side wall 16 is folded about its fold line 21 so as to directly overlie the end wall 18, whereby the size of the blank is now reduced substantially in half. The glue strip 22 is thus in contact with the inner surface of the side wall 16 directly along the free edge thereof, and is suitably adhesively secured to this inner surface, such as by gluing. This thus results in the walls 16–19 all being joined together in an endless fashion to hence create an upright tubular structure of generally rectangular cross section when the box is assembled. Similarly, both of the inside bottom flaps 36 and 37, though glued to the respective end walls by the glue strips 49, also define hollow tubular structures which, in the illustrated embodiment, are of rectangular cross section when the box is assembled. The tubular structures defined by these flaps 36 and 37, however, extend horizontally across the width or length of the box, whereas the tubular structure defined by the walls 16–19 extends vertically or upright.

With the box in an assembled but flattened condition as described above, the box can be conveniently and economically transported, stored and handled.

Figure 3:
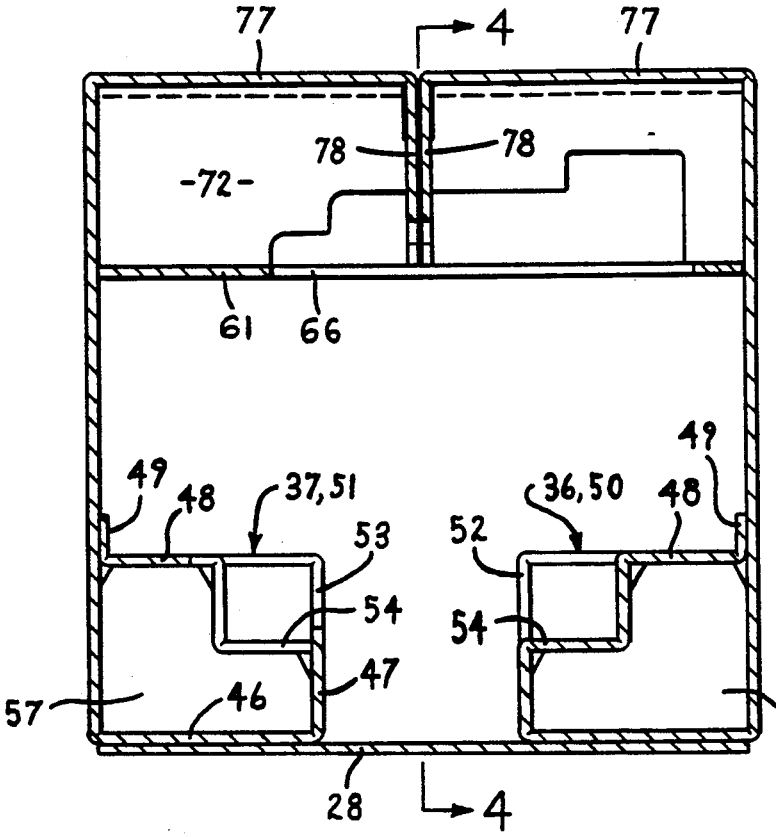
FIG. 3 is a cross-sectional view taken along line 3—3 of FIG. 4.
Figure 4:
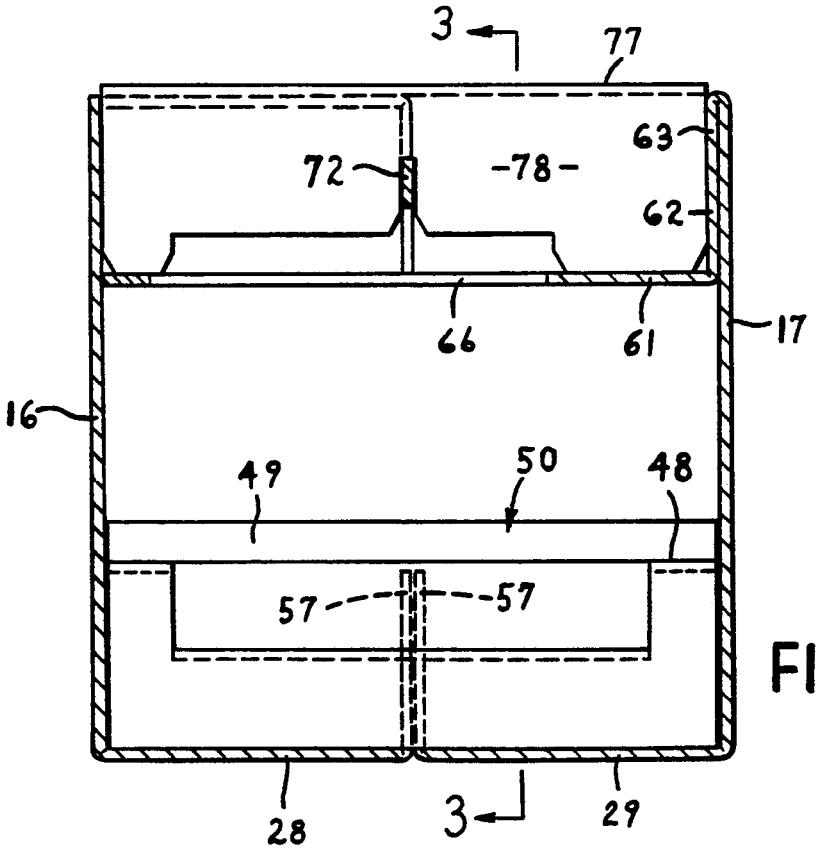
FIG. 4 is a cross-sectional view taken along line 4—4 of FIG. 3.

When use of the box is desired, then the flat or knock-down box is erected by opening the box so that the side walls 16–19 define an upright tubular side wall structure. The inner bottom flaps 36 and 37 are then expanded or opened up by folding the flaps inwardly about the fold line 32 which, due to the securement of strip 49 to the respective end wall, results in the tubular structures of the flaps 36 and 37 opening so as to assume the configurations illustrated by FIG. 3. Thereafter the outer bottom flaps 28 and 29 are each folded inwardly about the fold lines 32, and the tabs 57 folded inwardly and downwardly about the fold lines 58 so as to be insertable through the slots 56. The tabs 57 are preferably of sufficient height dimensions such that, when inserted through the slots 56, the free edge of the tab will abut under and provide support for the top wall 48 of the tubular support, as illustrated by FIG. 3. These tabs thus significantly rigidify the interior tubular supports. With the inner and outer bottom flaps assembled as described above, the tabs 85 are then manually pushed upwardly so as to deform the aligned tabs 86, thus causing tabs 85 to deform and pass through the openings defined by tabs 86 to thus interlock the overlying inner and outer bottom flaps together.

Thereafter an object can be positioned in the box and supported on the interior tubular supports, such as by being engaged within appropriate cutouts or recesses formed in the tubular supports. When the object is positioned within the box, part of the object may engage and hence its weight transferred to the top walls 48 of the supports 50, 51. However, due to presence of the cutouts or recesses 52, 53, there is generally also provided an upwardly facing support surface 54 which is created by means of a step-like formation formed in the tubular support. This support surface 54 is spaced down from the top wall 48 but upwardly from the box bottom and functions to engage and support a particular configuration of the object which is being deposited in the box. These walls 54 either totally or assist in supporting the weight of the object, and at the same time provide lateral constraint of the object due to its being confined sidewardly between the opposed recesses 52 and 53.

Thereafter the inner top flap 34 is folded inwardly so that the main restraint section 61 moves downwardly into the interior of the box so that the top portion of the object extends through the opening 66. The restraint section 61 is sized so as to extend substantially totally across the cross section of the box at a predetermined distance downwardly from the open upper end thereof, and the restraint opening 66 is sized to snugly accommodate the object to prevent sideward displacement of the object. The auxiliary fold line 65, which is optional, provides additional flexibility when the restraint section 61 is being properly positioned. When so positioned, the sections 62 and 63 project directly downwardly along the inside surface of the side wall 17 and result in the restraint section 61 being spaced downwardly from the top of the box by a dimension equal to the combined widths of the section 62 and 63.

Thereafter the other inner top flap 33 is folded inwardly about hinge line 31, and the free flap portion 72 thereof is folded downwardly about the hinge line 73 so that the free edges 74 abut the upper surface of the restraint section 61. The two outer top flaps 26 and 27 are then both folded inwardly about the fold line 31, and the free tab portions 78 thereof are folded downwardly about the fold lines 79, which tab portions 78 at one end thereof project downwardly through the slot 76 formed in the inner top flap section 71 so that the free edges 82 abut the top of the restraint section 61. The slot 81 formed in the tab section 78 accommodates the downwardly-projecting tab portion 72 of the inner top flap section 33. The remaining halves of the flaps 78 merely directly abut one another as they project downwardly for abutting contact with the upper surface of the restraint section 61.

In this manner the box securely and stationarily holds an object within the box in a restrained manner, both vertically and horizontally, and at the same time the box provides the necessary strength, rigidity and protection so as to permit secure and generally closed storage and shipment of the object. Further, when the knock-down boxes are being stored at the point of use, such storage can be accomplished economically with minimal space, and without requiring multiple components. Assembly is also greatly simplified since a single operator can easily assembled (i.e. erect) the box since subassembly of individual components followed by assembly of multiple components is not required. Further, gluing of box components at the point of use is not required.

With the improved box of the present invention, as described above, there can thus be provided a strong and secure box which permits safe and secure support and suspension of an article within the box, and at the same time the box can be readily assembled at the job site due to the box being formed in one piece from a single blank. Further, the construction of the tubular interior supports as an integral part of the box, the cooperation of these supports with the foldable outer bottom flaps, and the interlocking of the bottom flaps and supports enables the box to be utilized for transporting of an object without requiring any gluing or taping of the bottom of the box. While gluing or taping can be provided if desired, nevertheless such is not required.

Although a particular preferred embodiment of the invention has been disclosed in detail for illustrative purposes, the invention contemplates such changes and modifications therein that lie within the scope of the pending claims.

The embodiments of the invention in which an exclusive property or privilege is claimed are defined as follows:

1. A one-piece, top-opening, container made entirely from a one-piece blank of corrugated cardboard, comprising:

a pair of opposed end wall panels and a pair of opposed side wall panels foldably joined to each other along parallel transverse fold lines to form an upright tubular container;

top and bottom closure means for respectively closing top and bottom ends of said container;

said bottom closure means comprising at least one object support projecting upwardly into the interior of the container and adapted for supporting an object that is packaged in said container, said object support including foldably joined panel sections and having an upper edge fixed joined to one of said end wall panels so that said panel sections lie substantially flat against the lower portion of said one end wall panel when the container is in a flat knocked-down condition; and said top closure means comprising at least one restraint wall section extending across the interior of said container at a location spaced downwardly from the top end of the container and having means for engaging the object to restrict movement of the object in the container, said restraint wall section being integral with one of said panels and being foldably joined thereto by a fold line.

2. A container as claimed in claim 1 in which said top closure means comprises two outer top flaps foldably joined to said end wall panels and extending toward each other across the top end of the container to close the top end thereof, two inner top flaps foldably joined to said side wall panels and extending toward each other, one of said inner top flaps defining said restraint wall section and including a first section foldably joined to an upper edge of its associated side wall panel and adapted to extend interiorly downwardly therealong to a location spaced downwardly from the upper edge and a second section which extends from a lower end of said first section transversely across the container, said second section having said means for engaging an upper portion of the object to restrain its movement inside the container, said outer top flaps and the other of said inner top flaps having downwardly extending flap sections extending to said second section of said one inner top flap whereby to restrain upward movement of said second section.

3. A container as claimed in claim 2 in which said bottom closure means comprises two outer bottom flaps foldably joined to said side wall panels and extending toward each other across the bottom end of the container to close the bottom end thereof, two inner bottom flaps foldably joined to said end wall panels and extending toward each other across the bottom end of the container and above said outer bottom flaps; and at least one of said inner bottom flaps comprising a first section which extends horizontally inwardly from the lower end of its respective end wall panel, a second section which extends upwardly from an inner edge of said first section and outwardly to the respective end wall panel, and a third section which extends vertically from an outer edge of said second section alongside the respective end wall panel and which is fixed secured to said end wall panel.

4. A top-opening box made entirely from a one-piece blank of corrugated cardboard for permitting secure and stationary storage of an object within the interior of the box when the object has a size and/or configuration different from the interior of the box, comprising:

a generally upright tubular side wall structure of generally rectangular cross section defined by pairs of first and second opposed and generally parallel side wall panels, said first and second side wall panels being foldably joined to one another along parallel and generally vertically extending fold lines;

bottom closure means for closing off a bottom end of said box, said bottom closure means including two bottom flaps foldably joined to lower edges of an opposed pair of said side wall panels about substantially horizontal fold lines and extending toward each other across the bottom end of the box to close the bottom end thereof;

top closure means for closing a top end of said box, said top closure means including a pair of top flaps foldably joined to upper edges of an opposed pair of said side wall panels and extending inwardly toward one another across the top end of the box to close the top end thereof;

top object restraint means integrally joined to said tubular side wall structure and projecting horizontally across substantially both width and length dimensions of the box interior at a location spaced downwardly a predetermined distance from the top end of the box for engaging and horizontally restraining the object positioned within the box;

said object restraint means including a generally horizontally enlarged restraining panel extending substantially horizontally across the entire cross section of the box at said location spaced downwardly from the top end thereof, said restraining panel having an opening therethrough for permitting an upper portion of the object to project into and upwardly through said opening;

said restraint means also including a connecting panel disposed vertically directly adjacent an interior surface of one of said side wall panels, said connecting panel having an upper edge joined about a fold line to an upper edge of said last-mentioned side wall panel, said connecting panel having a lower edge joined about a further fold line to one edge of said restraining panel.

5. A box according to claim 4, wherein said top flaps have tabs integrally joined thereto and projecting downwardly into the interior of said box so that lower edges of said tabs substantially abuttingly contact said restraining panel for preventing upwardly movement thereof.

6. A box according to claim 5, wherein said connecting panel is joined to an upper edge of one of said first side wall panels, wherein said top flaps are joined about fold lines to upper edges of said opposed second side wall panels, and a hold-down flap joined along one edge thereof through a fold line to an upper edge of the other of said first side wall panels, said hold-down flap including a section which projects inwardly partially across the top end of said box, said last-mentioned section being disposed directly under said top flaps, said last-mentioned section terminating in an outer edge which is disposed approximately midway between the opposed first side wall panels and which defines a fold line to which is joined a downwardly projecting hold-down tab, said hold-down tab projecting vertically downwardly and terminating in a lower edge which abuttingly contracts the restraining panel for restricting upward movement thereof.

7. A container according to claim 6, wherein the section of said hold-down flap has a slot extending transversely thereof for permitting the tabs on the top flaps to project downwardly therethrough.

8. A top-opening box made entirely from a one-piece blank of corrugated cardboard for permitting secure and stationary storage of an object within the interior of the box when the object has a size and/or configuration different from the interior of the box, comprising:

a generally upright tubular side wall structure of generally rectangular cross section defined by pairs of first and second opposed and generally parallel side wall panels, said first and second side wall panels being foldably joined to one another along parallel and generally vertically extending fold lines;

object support means integrally joined to said tubular side wall structure adjacent a bottom end of said box and projecting at least partially inwardly across the bottom end and upwardly into the interior of said box for stationarily supporting a lower portion of the object, said support means defining a pair of generally hollow tubular structures which are generally horizontally elongated so as to extend interiorly across the width of the box corresponding to the width of said first side wall panel, said tubular structures projecting upwardly into the interior of said box from the bottom end thereof, said support means including two inner bottom flaps foldably joined to lower ends of the opposed pair of first side wall panels about generally horizontal fold lines;

bottom closure means disposed below said object support means for closing off the bottom end of said box, said bottom closure means including two outer bottom flaps foldably joined to lower edges of said second side wall panels about substantially horizontal fold lines and extending toward each other across the bottom end of the box to close the bottom end thereof;

top closure means for closing a top end of said box, said top closure means including a pair of top flaps foldably joined to upper edges of an opposed pair of said side wall panels and extending inwardly toward one another across the top end of the box to close the top end thereof; and top object restraint means integrally joined to said tubular side wall structure and projecting substantially horizontally across both width and length dimensions of the box interior at a location spaced downwardly a predetermined distance from the top end of the box for engaging and horizontally restraining the object positioned within the box;

said object restraint means including a generally horizontally enlarged restraint panel extending substantially horizontally across the entire cross section of the box at said location, said restraint panel having an opening therethrough for permitting an upper portion of the object to project into and upwardly through said opening;

said restraint means also including a connecting panel disposed vertically directly adjacent an interior surface of one of said side wall panels, said connecting panel having an upper edge joined about a fold line to an upper edge of said last-mentioned side wall panel, said connecting panel having a lower edge joined about a further fold line to one edge of said restraint panel.

9. A box according to claim 8, wherein said top flaps have tabs integrally joined thereto and projecting downwardly into the interior of said box so that lower edges of said tabs substantially abuttingly contact said restraint panel for preventing upwardly movement thereof.

10. A box according to claim 9, wherein said top flaps are joined about fold lines to upper edges of an opposed pair of said side wall panels, wherein said connecting panel is joined to an upper edge of another one of said side wall panels, and a hold-down flap joined along one edge thereof through a fold line to an upper edge of the remaining one of said side wall panels, said hold-down flap including a section which projects inwardly partially across the top end of said box, said last-mentioned section being disposed directly under said top flaps, said last-mentioned section terminating in an outer edge which is disposed approximately midway between the opposed side wall panels and which defines a fold line to which is joined a downwardly projecting hold-down tab, said hold-down tab projecting vertically downwardly and terminating in a lower edge which abuttingly contacts the restraint panel for restricting upward movement thereof.

11. A container according to claim 10, wherein the hold-down flap has a transversely extending slot therethrough for permitting the hold-down tabs on the top flaps to project downwardly therethrough.

12. A box according to claim 8, wherein each inner bottom flap includes a first panel section which extends horizontally inwardly from the bottom end of its respective first side wall panel, a second panel section joined by a fold line to an inner edge of said first panel section, said second panel section projecting upwardly into the interior of the box from said last-mentioned fold line and is joined at its upper edge by a fold line to a third panel section which projects transversely relative to said second panel section so as to terminate substantially adjacent the respective first side wall panel, whereby said tubular structure is of a generally four-sided cross section defined by the respective inner bottom flap and a cooperating lower portion of the respective first side wall panel, said third panel section connecting to a striplike edge panel section which defines the free edge of said inner bottom flap and which is disposed in contact with and fixedly secured to the respective first side wall panel.

13. A box according to claim 12, wherein said outer bottom flaps each comprise a first section which extends horizontally inwardly from the bottom end of the respective second side wall panel so that at least a part of said first section directly underlies and substantially supportively engages a part of said first panel section, said outer bottom flaps each also including a second section which has a lower edge thereof joined about a fold line to an inner edge of said first section, said second section extending upwardly from said last-mentioned fold line and terminating in a free edge of said respective outer bottom flap, said second section comprising solely a pair of tablike portions which extend upwardly from said last-mentioned fold line and which are sidewardly spaced apart so that said tabs project upwardly into the interior of said tubular supports for supportive engagement therewith, said tabs projecting upwardly through slots formed in said first panel sections.

14. A one-piece blank of corrugated cardboard for forming a top-opening box, comprising:

first, second, third and fourth generally rectangular wall panels joined longitudinally in series, a first fold line defined between said first and second wall panels, a second fold line defined between said second and third wall panels, a third fold line defined between said third and fourth wall panels, and a fourth fold line defined between said fourth wall panel and a narrow securing strip which is adapted to be fixedly secured to said first wall panel when the blank is assembled, all of said first through fourth fold lines extending in generally parallel relationship;

said blank including a fifth fold line extending longitudinally along one edge of said first through fourth wall panels and a sixth fold line extending longitudinally along the other edge of said first through fourth wall panels, said fifth and sixth fold line being generally parallel with one another and extending in generally perpendicular relationship with respect to said first through fourth fold lines, said first and third wall panels being of substantially the same dimensions and defining a first pair, and said second and fourth wall panels being of substantially the same dimensions and defining a second pair;

first and second object-positioning flaps integrally and respectively joined to the wall panels of one said pair about said fifth fold line and projecting transversely away from the respective wall panels in generally coplanar relationship therewith, each of said object-positioning flaps including a first panel-like section which project outwardly away from said fifth fold line and terminates in a seventh fold line which is generally parallel with said fifth fold line, a second panel-like section which projects outwardly away from seventh fold line and terminates in a eighth fold line which is generally parallel with said seventh fold line, and a strip-like edge section which projects outwardly from said eighth fold line and terminates in a free edge, said edge section functioning as a adhesive securing strip when the blank is assembled, and said second panel-like section having recess means associated therewith for cooperative positioning relationship with the object to be stored in the box, whereby said object-positioning flap can be folded into a generally tubular configuration disposed interiorly of the box adjacent the bottom thereof for positioning engagement with the object;

first and second bottom flaps integrally and respectively joined to the wall panels of said other pair about said fifth fold line, said bottom flaps being adapted to be folded inwardly for closing off the bottom end of the box when assembled and for supportive disposition directly under the assembled object-positioning flaps;

object-restraining flap integrally joined to an edge of a remaining one of said side wall panels through said sixth fold line and projecting outwardly in substantially coplanar relationship with the respective side wall panel, said object-restraining flap including an enlarged restraining panel having length and width dimensions which substantially correspond to the horizontal cross sectional length and width dimensions of the box interior when the box is assembled, said restraining panel having opening means therethrough for permitting an upper portion of the object to project therethrough, and a connecting panel having one edge joined through said sixth fold line to the respective side wall panel and an opposite edge joined through a ninth fold line to an edge of said restraining panel, said sixth and ninth fold lines being generally parallel and spaced a predetermined distance apart so as to require that the restraining panel be positioned downwardly a predetermined distance from the top end of the box when assembled; and top flap means integrally joined to at least one of said side wall panels through said sixth fold line and projecting substantially outwardly from said one side wall panel in substantially coplanar relationship therewith, said top flap means being foldable inwardly so as to extend across the top end of the assembled box to effect closing thereof.

15. A blank according to claim 14, wherein said top flap means includes a pair of top flaps which are integrally joined through the sixth fold line to upper edges of opposed side wall panels of one of said pairs, said top flaps being foldable inwardly toward one another so as to extend across and close off the top end of the box when assembled, and said object-restraining flap being joined to an upper edge of one of the side wall panels of the remaining pair.

16. A blank according to claim 15, including a hold-down flap integrally joined through said sixth fold line to an upper edge of the other side wall panel of said remaining pair so as to project transversely outwardly therefrom in substantially coplanar relationship therewith, said hold-down flap including a top panel portion which extends from said sixth fold line through a distance which is significantly less than the spacing between the opposed side wall panels of said remaining pair so as to terminate at a tenth fold line which is generally parallel with said sixth fold line, and a hold-down tab structure joined to said top panel at said tenth fold line and projecting outwardly therefrom so as to terminate in a free edge, the perpendicular distance between said free edge and said tenth fold line being substantially equal to the width of said connecting panel as defined perpendicularly between said sixth and ninth fold lines.

* * * * *